US011330846B2

(12) United States Patent
Tanenbaum

(10) Patent No.: US 11,330,846 B2
(45) Date of Patent: May 17, 2022

(54) UNDERWEAR ASSEMBLY

(71) Applicant: Boxem, LLC, Atlanta, GA (US)

(72) Inventor: Aaron Tanenbaum, Sandy Springs, GA (US)

(73) Assignee: BOXEM, LLC, Atlanta, GA (US)

( * ) Notice: Subject to any disclaimer, the term of this patent is extended or adjusted under 35 U.S.C. 154(b) by 292 days.

(21) Appl. No.: 15/959,667

(22) Filed: Apr. 23, 2018

(65) Prior Publication Data

US 2018/0317564 A1 Nov. 8, 2018

Related U.S. Application Data

(60) Provisional application No. 62/500,761, filed on May 3, 2017.

(51) Int. Cl.

| | |
|---|---|
| ***A41B 9/02*** | (2006.01) |
| ***A41B 9/00*** | (2006.01) |
| ***A41F 17/00*** | (2006.01) |

(52) U.S. Cl.

CPC ..... *A41B 9/023* (2013.01); *A41B 9/004* (2013.01); *A41F 17/00* (2013.01); *A41B 2300/33* (2013.01)

(58) Field of Classification Search

CPC .. A41B 9/00; A41B 9/02; A41B 9/023; A41B 9/026; A41B 9/004; A41B 9/005; A41B 9/007; A41B 2300/33; A41B 9/14; A41F 17/00; A41D 1/06; A41D 1/062; A41D 1/065; A41D 1/089

USPC ..... 2/400, 403, 404, 405

See application file for complete search history.

(56) References Cited

U.S. PATENT DOCUMENTS

| | | | | |
|---|---|---|---|---|
| 2,034,312 A * | 3/1936 | Rubin | A41D 1/06 2/228 |
| 3,854,978 A * | 12/1974 | Campbell, Sr | D06N 7/0092 427/375 |
| D269,919 S | 8/1983 | Gabrelcik | |
| 4,805,243 A | 2/1989 | Gibbens et al. | |
| 5,103,501 A | 4/1992 | Meisels | |
| 5,276,923 A | 1/1994 | Cohen | |
| 5,379,462 A * | 1/1995 | Morgan | A41B 9/02 2/238 |
| 5,647,065 A | 7/1997 | Richerson | |
| 5,978,971 A | 11/1999 | Wald | |

(Continued)

FOREIGN PATENT DOCUMENTS

| | | |
|---|---|---|
| KR | 20030038059 | 5/2003 |
| WO | 2018204111 | 11/2018 |

OTHER PUBLICATIONS

Undershirtguy.com, Article entitled: "The 10 Best Ways to Keep Your Shirt Tucked", located at <http://undershirtguy.com/the-10-best-ways-to-keep-your-shirt-tucked/> , accessed on Feb. 17, 2017, 16 pgs.

(Continued)

*Primary Examiner* — F Griffin Hall

(74) *Attorney, Agent, or Firm* — Taylor English Duma LLP

(57) ABSTRACT

An underwear assembly includes an outer layer; and an inner layer, the inner layer disposed within the outer layer, the inner layer defining an access hole configured to receive a penis, a scrotum, and testicles of a user, the access hole configured to prevent withdrawal of the penis, the scrotum, and the testicles from between the inner layer and the outer layer to internal to the inner layer through the access hole.

23 Claims, 2 Drawing Sheets

(56) References Cited

U.S. PATENT DOCUMENTS

| | | | | |
|---|---|---|---|---|
| 6,108,823 | A | 8/2000 | Danes | |
| 6,145,132 | A | 11/2000 | Towner | |
| D434,545 | S | 12/2000 | Maastricht | |
| 6,287,169 | B1 | 9/2001 | Willms et al. | |
| D456,995 | S | 5/2002 | Baker | |
| 6,662,378 | B2 | 12/2003 | Vartanyan | |
| 7,024,703 | B1 | 4/2006 | Della Ratta | |
| 7,065,797 | B1 | 6/2006 | Chen | |
| D561,978 | S | 2/2008 | Soulides | |
| 8,202,722 | B2 | 6/2012 | Asogawa | |
| D663,102 | S | 7/2012 | Hogg | |
| D672,530 | S | 12/2012 | Williams | |
| D678,660 | S | 3/2013 | Fryer | |
| 8,528,114 | B2 * | 9/2013 | Baiany | A41D 7/005 2/67 |
| 8,601,615 | B2 | 12/2013 | Isaacson et al. | |
| 8,607,367 | B2 | 12/2013 | Jones | |
| D704,921 | S | 5/2014 | Tsou | |
| 8,769,780 | B1 | 7/2014 | Segel | |
| D743,670 | S | 11/2015 | Gust | |
| 9,433,250 | B2 | 9/2016 | Merchen | |
| D788,287 | S | 5/2017 | Koster | |
| D860,583 | S | 9/2019 | Bauer | |
| D916,429 | S | 4/2021 | Tanenbaum | |
| 2002/0053102 | A1 | 5/2002 | Vartanyan | |
| 2007/0220661 | A1 | 9/2007 | Blohmann | |
| 2007/0277285 | A1 * | 12/2007 | Gravette | A41B 9/023 2/78.1 |
| 2007/0283484 | A1 * | 12/2007 | Wright | A41B 9/02 2/404 |
| 2008/0229487 | A1 | 9/2008 | Kewon | |
| 2010/0058517 | A1 | 3/2010 | Perolari | |
| 2012/0084903 | A1 | 4/2012 | Roberts et al. | |
| 2012/0255103 | A1 | 10/2012 | Evenstad | |
| 2013/0061858 | A1 * | 3/2013 | Saeteurn | A61F 13/4915 128/891 |
| 2013/0139302 | A1 * | 6/2013 | Delija | A41B 9/023 2/403 |
| 2013/0219591 | A1 * | 8/2013 | Gu | A41B 9/002 2/405 |
| 2015/0040285 | A1 | 2/2015 | Mobayyen | |
| 2016/0324238 | A1 | 11/2016 | Tran | |
| 2019/0041166 | A1 | 2/2019 | Hexels | |

OTHER PUBLICATIONS

Tanenbaum, Aaron; International Search Report and Written Opinion for PCT Application No. PCT/US2018/028830, filed Apr. 23, 2018, dated Jul. 5, 2018, 9 pgs.

Amazon; Article entitled: "Hanes Men's 10 Pack B/g Boxer Brief", located at <https://www.amazon.com/Hanes-1 0-Pack-Boxer-Brief-Assorted/dp/B01 KOH75I8/ref=pd_sbs_ 193_3/140- 2395075-4176949? encoding=UTF8&pd rd i=FB01 KOH71 W8&pd rd r=c8dccaac-715f-4c6c-8200->, accessed on Feb. 10, 2020, 7 pgs.

Tanenbaum, Aaron; Non-Final Office Action for U.S. Appl. No. 29/645,009, filed Apr. 23, 2018, dated Feb. 12, 2020, 18 pgs.

Tanenbaum, Aaron; Non-Final Office Action for U.S. Design U.S. Appl. No. 29/645,009, filed Apr. 23, 2018, dated Aug. 20, 2020, 5 pgs.

Tanenbaum, Aaron; Corrected Notice of Allowance for Design U.S. Appl. No. 29/645,009, filed Apr. 23, 2018, dated Mar. 16, 2021, 6 pgs.

Tanenbaum, Aaron; Notice of Allowance for Design U.S. Appl. No. 29/645,009, filed Apr. 23, 2018, dated Dec. 15, 2020, 11 pgs.

* cited by examiner

UNDERWEAR ASSEMBLY

CROSS-REFERENCE TO RELATED APPLICATIONS

This application claims the benefit of U.S. Provisional Application No. 62/500,761, filed on May 3, 2017, which is hereby incorporated by reference in its entirety.

TECHNICAL FIELD

This disclosure relates to underwear. More specifically, this disclosure relates to an underwear assembly that can prevent chafing and irritation to male genitals.

BACKGROUND

There are several types of underwear available in the market that can provide different comforts and fits. Boxers are typically loose-fitting shorts that can provide comfort in their loose fit, while boxer briefs provide a tighter snug fit on the wearer's legs to promote movement and flexibility. Boxer briefs are often preferred for athletic wear as well. Boxer briefs can provide added support to a male user's genitals; however, the tighter snug fit can reduce air flow to the groin and genital region. Existing underwear, such as boxers and boxer briefs, also fail to provide separation between the user's genital region and thighs. For example, the male user's penis and testicles can rub against his inner thighs. This effect can cause irritation, chafing, dermatological issues such as jock itch, and general discomfort. This rubbing can be particularly uncomfortable during athletic pursuits or in hot weather when salt from the user's sweat can exacerbate the irritation.

Additionally, in modern fashion, etiquette dictates that men and women tuck their shirts into a waist of their pants, shorts, or skirts in many settings. Shirts often become fully or partially untucked when a user bends over, sits down, raises his or her arms, or twists at the waist. Untucking of shirts can be particularly common during athletic pursuits such as swinging a club at a ball while golfing. Incidental untucking of a shirt tail can be undesirable in settings in which etiquette requires a tucked-in shirt and neat dress.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

Disclosed is an underwear assembly comprising an outer layer; and an inner layer, the inner layer disposed within the outer layer, the inner layer defining an access hole configured to receive a penis, a scrotum, and testicles of a user, the access hole configured to prevent withdrawal of the penis, the scrotum, and the testicles from between the inner layer and the outer layer to internal to the inner layer through the access hole.

Also disclosed is a method of using an underwear assembly, the method comprising inserting a first leg of a user through a first inner leg of an inner layer of the underwear assembly; inserting a second leg of a user through a second inner leg of the inner layer; and pulling a penis, a scrotum, and testicles of the user through an access hole defined by the inner layer.

Also disclosed is an underwear assembly comprising an inner layer, the inner layer defining an access hole configured to receive a penis, a scrotum, and testicles of a user; an outer layer covering the inner layer; and a waistband attached to the inner layer.

Various implementations described in the present disclosure may include additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The features and components of the following figures are illustrated to emphasize the general principles of the present disclosure. The drawings are not necessarily drawn to scale. Corresponding features and components throughout the figures may be designated by matching reference characters for the sake of consistency and clarity.

DETAILED DESCRIPTION

Figure 1:
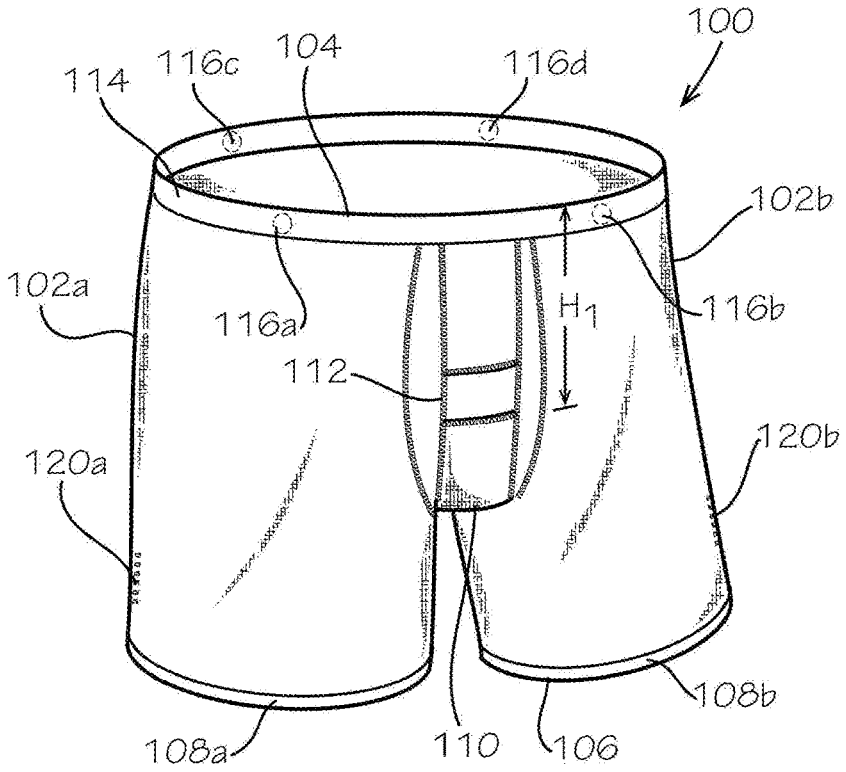
FIG. 1 is a front perspective view of an inner layer of an underwear assembly in accordance with one aspect of the current disclosure.

The present disclosure can be understood more readily by reference to the following detailed description, examples, drawings, and claims, and the previous and following description. However, before the present devices, systems, and/or methods are disclosed and described, it is to be understood that this disclosure is not limited to the specific devices, systems, and/or methods disclosed unless otherwise specified, and, as such, can, of course, vary. It is also to be understood that the terminology used herein is for the purpose of describing particular aspects only and is not intended to be limiting.

The following description is provided as an enabling teaching of the present devices, systems, and/or methods in its best, currently known aspect. To this end, those skilled in the relevant art will recognize and appreciate that many changes can be made to the various aspects of the present devices, systems, and/or methods described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to "an element" can include two or more such elements unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance can or cannot occur, and that the description includes instances where said event or circumstance occurs and instances where it does not.

The word "or" as used herein means any one member of a particular list and also includes any combination of members of that list. Further, one should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily include logic for deciding, with or without user input or prompting, whether these features, elements and/or steps are included or are to be performed in any particular aspect.

Disclosed are components that can be used to perform the disclosed methods and systems. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and systems. This applies to all aspects of this application including, but not limited to, steps in disclosed methods. Thus, if there are a variety of additional steps that can be performed it is understood that each of these additional steps can be performed with any specific aspect or combination of aspects of the disclosed methods.

Disclosed is an underwear assembly and associated methods, systems, devices, and various apparatus. The underwear assembly comprises an inner layer, an outer layer, and an attachment mechanism. It would be understood by one of skill in the art that the disclosed underwear assembly is described in but a few exemplary embodiments among many. No particular terminology or description should be considered limiting on the disclosure or the scope of any claims issuing therefrom.

FIG. 1 shows a front perspective view of an inner layer 100, or "neath" layer, of an underwear assembly 200 (shown in FIG. 2) in accordance with one aspect of the disclosure. The inner layer 100 can define a first side 102*a* and a second side 102*b*. The first side 102*a* can be disposed opposite from the second side 102*b*. The inner layer 100 can also define a top 104 and a bottom 106. The top 104 and the bottom 106 can be defined between the first side 102*a* and the second side 102*b*, and the top 104 can be disposed opposite from the bottom 106.

The bottom 106 of the inner layer 100 can define a first inner leg 108*a* and a second inner leg 108*b* which can be joined together by a crotch 110 of the inner layer 100. When worn by a user, legs of the user extend through the first inner leg 108*a* and the second inner leg 108*b*. The inner layer 100 can define an access hole 112 defined in a front side of the inner layer 100. The access hole 112 can be substantially centered between the first side 102*a* and the second side 102*b*, and the access hole 112 can be positioned above the crotch 110 of the inner layer 100. The access hole 112 can be configured to allow a male user's penis, scrotum, and testicles (not shown) to extend through the access hole 112 such that the penis, scrotum, and testicles can be disposed external to the inner layer 100. In the present aspect, the access hole 112 can be substantially square or rectangular; however, in other aspects, the access hole 112 can define a different shape, such as oval, circular, triangular, trapezoidal, quadrilateral, diamond, pentagonal, hexagonal, or any other suitable shape, for example and without limitation.

The access hole 112 can be configured to hug a base of the penis and scrotum proximate to a pelvis of the user. Hugging the base of the user's penis and scrotum can secure the penis, scrotum, and testicles external to the inner layer 100 and prevent withdrawal, retraction, or reversion of the penis, scrotum, and testicles back through the access hole 112. In other aspects, the access hole 112 may not snuggly hug the base of the penis and scrotum proximate to the pelvis of the user, and instead, the access hole 112 can be sized to provide a looser fit around the base of the penis and scrotum. In such aspects, the access hole 112 can still be sized to prevent withdrawal, retraction, or reversion of the penis, scrotum, and testicles back through the access hole 112. In the present aspect, the access hole 112 can comprise an elastic material extending around the access hole 112, and the elastic material can be configured to snugly and comfortably fit the access hole 112 around the base of the user's penis and scrotum without causing discomfort by squeezing the base of the user's penis and scrotum too tightly. In other aspects, the access hole 112 may not comprise the elastic material, and a non-elastic material can extend around the access hole 112. The elastic material can be spandex, elastane, latex, or any other suitable elastomeric. In other aspects, the access hole 112 can be adjustable in size, and the access hole 112 can comprise a draw string or other suitable constricting mechanism configured to cinch the access hole 112 down around the base of the user's penis and scrotum. In such aspects, the access hole 112 may or may not comprise the elastic material.

With the user's penis, scrotum, and testicles positioned external to the inner layer 100, contact between the user's penis and scrotum with the user's thighs can be prevented.

The first inner leg 108*a* and the second inner leg 108*b* of the inner layer 100 can also assist in preventing contact. By avoiding direct contact between the user's thighs and the user's penis and scrotum, chafing and irritation can be minimized or eliminated by preventing skin-on-skin rubbing of the penis and scrotum with the thighs. During athletic pursuits, sweat often accumulates between the penis, scrotum, and thighs. In the present aspect, the inner layer 100 can comprise a moisture wicking material which can draw sweat and moisture away from the penis and scrotum and prevent buildup of moisture in a user's groin. Additionally, with the user's penis, scrotum, and testicles disposed external to the inner layer 100, the user's penis, scrotum, and testicles can experience increased air flow and air circulation which can aid in cooling the user's penis, testicles, and scrotum. Cooling the user's testicles and scrotum can have the added benefit of promoting sperm production and fertility which can both be negatively impacted when the testicles experience excessively warm temperatures for prolonged periods.

The access hole 112 can also be configured to facilitate use of toilet facilities for a male user without necessitating pulling down, removing, or otherwise manipulating the inner layer 100 when worn by the user. A bottom of the access hole 112 can be disposed at a hole height $H_1$ measured from the top 104 of the inner layer 100. In other aspects, the inner layer 100 may not define the access hole 112, and the inner layer 100 can define a plain front. In other aspects, the inner layer 100 can define a slit or flap which can be configured to self-close but still allow use of toilet facilities without necessitating pulling down or removing the inner layer 100 when worn by the user.

The inner layer 100 can comprise an inner waistband 114 disposed at the top 104. The inner waistband 114 can be configured to extend around a waist of the user when the user wears the underwear assembly 200. The inner waistband 114 can comprise the elastic material or a different elastic material from the access hole 112. The inner waistband 114 can comprise a plurality of inner restraint mechanisms distributed around a girth of the inner waistband 114. In the present aspect, the inner restraint mechanisms can be inner magnets, as represented by a first inner magnet 116*a* and a second inner magnet 116*b* on the front side of the inner waistband 114. The inner waistband 114 can further comprise a third inner magnet 116*c* and a fourth inner magnet 116*d* which can be disposed on a back side of the inner waistband 114.

In the present aspect, the inner magnets 116 can be equally distributed around the girth of the inner waistband 114. The quantity and distribution of the inner magnets 116 should not be considered limiting, and the inner layer 100 can comprise greater or fewer than four inner magnets 116, and the inner magnets 116 can be disposed in any suitable distribution around the inner waistband 114 or the top 104 of the inner layer 100. In the present aspect, each inner magnet 116 can be sewn into a pocket defined between a first layer and a second layer of the inner waistband 114 in order to secure the inner magnets 116 in the inner waistband 114 without causing discomfort to the user. The pocket can be configured to maintain and secure an orientation of each inner magnet 116 such that the orientation cannot be accidentally reversed. In other aspects, each inner magnet 116 can be attached to the inner waistband 114 through a process such as gluing or any other suitable attachment process.

The underwear assembly 200 (shown in FIG. 2) can further comprise a first attachment mechanism 120*a* disposed on the first side 102*a* and a second attachment mechanism 120*b* disposed on the second side 102*b*. The attachment mechanisms 120*a,b* can be configured to attach the inner layer 100 to an outer layer 201 (shown in FIG. 2) of the underwear assembly 200. In the present aspect, each attachment mechanism 120*a,b* can be a portion of stitching; however, in other aspects, each attachment mechanism 120*a,b* can be a button, a button hole, a hook-and-latch, hook-and-loop fasteners, a zipper, or any other suitable attachment mechanism to permanently or removably attach the inner layer 100 to the outer layer 201. In other aspects, the attachment mechanisms 120*a,b* may not be disposed on the sides 102*a,b* of the inner layer 100 and can instead be disposed on the front side or the back side of the inner layer 100. The underwear assembly 200 can also comprise greater or fewer than two attachment mechanisms.

Figure 2:
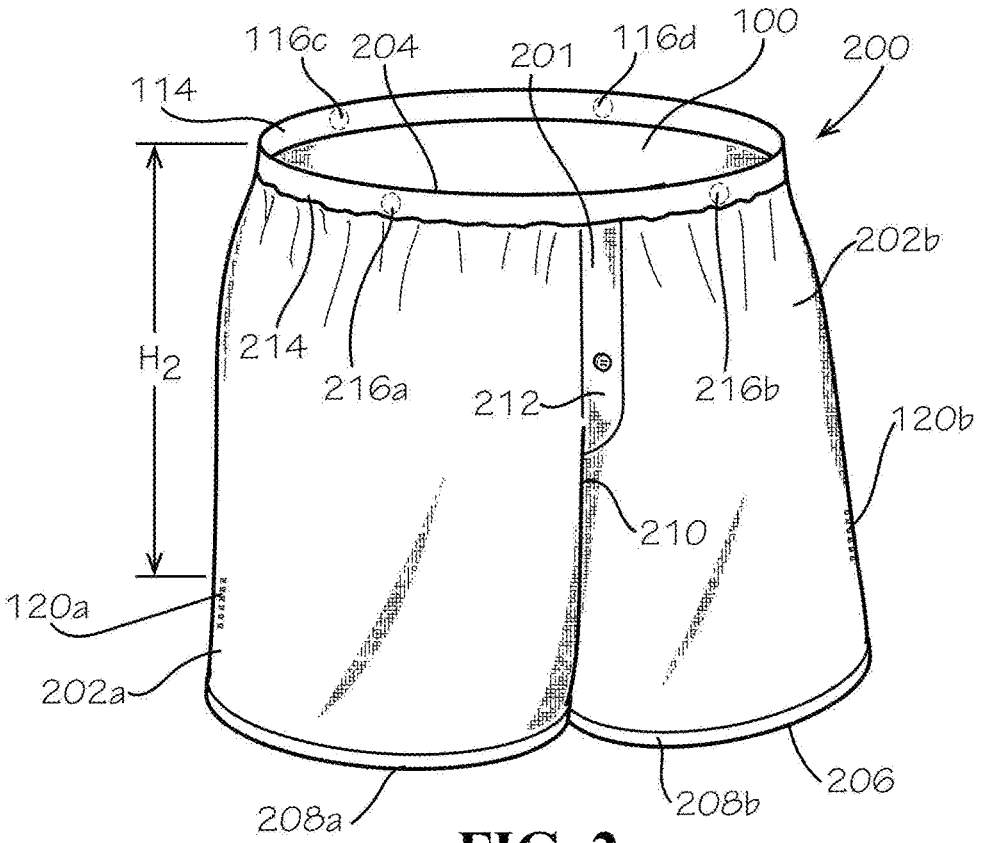
FIG. 2 is a front perspective view of the underwear assembly.

FIG. 2 shows a front perspective view of the underwear assembly 200. As previously described, the underwear assembly 200 can comprise the inner layer 100, the outer layer 201, and at least one attachment mechanism 120 attaching the inner layer 100 to the outer layer 201. In an assembled configuration as shown, the inner layer 100 can be disposed within the outer layer 201 as shown. In the present aspect, the outer layer 201 can conceal the inner layer 100 from view when the user wears the underwear assembly 200.

The outer layer 201 can define a first side 202*a* and a second side 202*b*. The first side 202*a* can be disposed opposite from the second side 202*b*. The outer layer 201 can also define a top 204 and a bottom 206. The top 204 and the bottom 206 can be defined between the first side 202*a* and the second side 202*b*, and the top 204 can be disposed opposite from the bottom 206.

The bottom 206 of the outer layer 201 can define a first outer leg 208*a* and a second outer leg 208*b* which can be joined together by a crotch 210 of the outer layer 201. In the assembled configuration, the first inner leg 108*a* (shown in FIG. 1) of the inner layer 100 can extend into the first outer leg 208*a*, and the second inner leg 108*b* (shown in FIG. 1) of the inner layer 100 can extend into the second outer leg 208*b*. The legs of the user can extend through both the inner legs 108*a,b* and the outer legs 208*a,b* when worn by the user. In other aspects, either the inner layer 100, the outer layer 201, or both may not define legs 108,208, and either the inner layer 100, the outer layer 201, or both can be formed in a brief shape.

In the present aspect, the inner layer 100 can demonstrate a snug fit for the user, similar to boxer briefs. In some aspects, the inner layer 100 can comprise the elastic material or another elastic material configured to hug the user, as seen in rash guards, compression shorts, and other athletic undergarments. The outer layer 201 can demonstrate a loose fit for the user, similar to boxer shorts. The loose fit of the outer layer 201 and the snug fit of the inner layer 100 can cooperate to prevent interference and bunching of material between the outer layer 201 and the inner layer 100. In other aspects, both the inner layer 100 and the outer layer 201 can demonstrate the loose fit. In other aspect, both the inner layer 100 and the outer layer 201 can demonstrate the snug fit. In the present aspect, the inner layer 100 and the outer layer 201 can be boxer length or boxer-brief length. In some aspects, either or both of the inner layer 100 and the outer layer 201 can be long underwear. In some aspects, either or both of the inner layer 100 and the outer layer 201 can be short underwear such as briefs.

In the present aspect, the outer layer 201 can define an access flap 212 extending upwards from the crotch 210 of the outer layer 201. The access flap 212 can substantially align with the access hole 112 (shown in FIG. 1) of the inner layer 100 in order to facilitate use of toilet facilities by the male user without necessitating pulling down or removing the outer layer 201 and inner layer 100. The user's penis, testicles, and scrotum can extend through the access hole 112, and the penis, testicles, and scrotum can be disposed between the inner layer 100 and the outer layer 201. The penis, testicles, and scrotum can be disposed external to the inner layer 100 and internal to the outer layer 201. The access flap 212 can simply be pulled to one side to create a hole through the outer layer 201 and allow access to the penis, testicles, and scrotum. In other aspects, the outer layer 201 can define a plain front without an access flap 212, slit, or other opening. In such aspects, the outer layer 201 can be pulled down to facilitate us of toilet facilities while the inner layer 100 can remain pulled up around the waist of the user.

This function can be facilitated by a placement of the attachment mechanisms 120*a,b* on the underwear assembly 200. The first attachment mechanism 120*a* can attach the first inner leg 108*a* (shown in FIG. 1) at the first side 102*a* to the first outer leg 208*a* at the first side 202*a*. The second attachment mechanism 120*b* can attach the second inner leg 108*b* (shown in FIG. 1) at the second side 102*b* to the second outer leg 208*b* at the second side 202*b*. As shown, a top of each attachment mechanism 120*a,b* can be disposed at an attachment height $H_2$ measured from the top 204 of the outer layer 201. In the present aspect, the attachment height $H_2$ can substantially equal the hole height $H_1$ (shown in FIG. 1) to allow the outer layer 201 to be easily pulled down below the access hole 112 (shown in FIG. 1). The placement of the attachment mechanisms 120*a,b* can also aid in securing a shirt tail of a tucked-in shirt, as further described below. In other aspects, the attachment height $H_2$ can be greater or smaller than the hole height $H_1$. In some aspects, the inner layer 100 may not be attached to the outer layer 201. In such aspects, the underwear assembly 200 may not comprise the attachment mechanisms 120*a,b*. In some aspects, the inner layer 100 can be worn by the user without the outer layer 201. In some aspects, the inner layer 100 can be provided separately and worn underneath conventional underwear, such as boxers, briefs, boxer-briefs, or any other suitable type of underwear.

Figure 3:
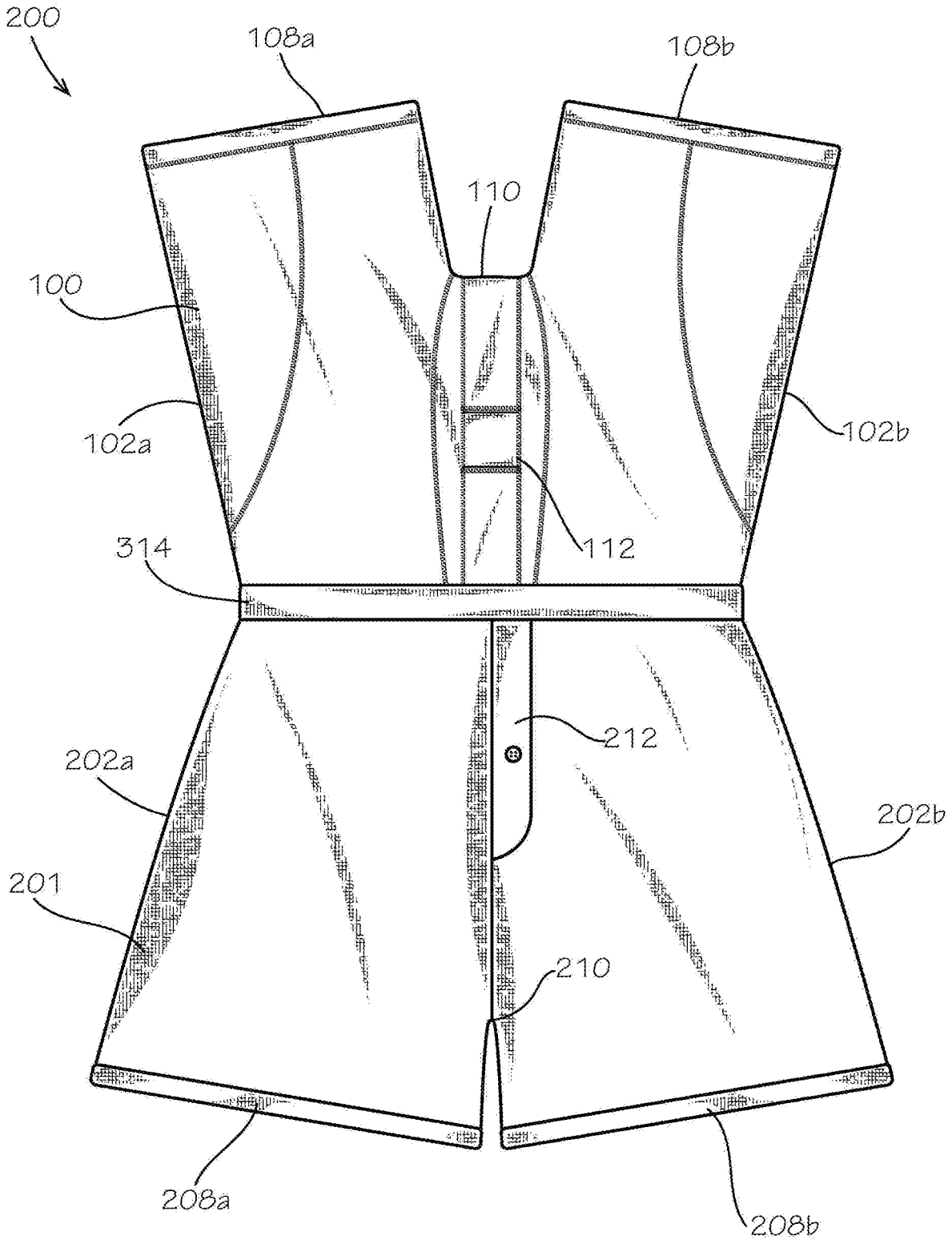
FIG. 3 is a front view of another aspect of the underwear assembly in accordance with another aspect of the present disclosure positioned with the inner layer turned inside-out from the outer layer.

In the present aspect, the outer layer 201 can comprise an outer waistband 214 disposed at the top 204. In some aspects, the outer waistband 214 can be attachable to the inner waistband 114, such as with a button-and-hole, hook-and-loop fasteners, a zipper, or any other suitable fastening mechanism. In the aspect of FIG. 3, the outer layer 201 may not comprise the outer waistband 214, and the outer layer 201 can be attached to the inner waistband 114 of the inner layer 100 (shown in FIG. 1), as further described below. In such aspects, the inner waistband 114 can be shared waistband 314 (shown in FIG. 3) between the inner layer 100 and the outer layer 201.

The outer waistband 214 can be configured to extend around the waist of the user when the user wears the underwear assembly 200, and the outer waistband 214 can align with the inner waistband 114 around the waist of the user. The outer waistband 214 can comprise an elastic material such as spandex, elastane, latex, or any other suitable elastomeric. The outer waistband 214 can comprise a plurality of outer restraint mechanisms distributed around the girth of the outer waistband 214. The outer restraint mechanisms can be configured to cooperate with the inner restraint mechanisms to restrain the shirt tail of the tucked-in shirt. In aspects in which the inner layer 100 and the outer layer 201 are attached to a shared waistband, such as the inner waistband 114, the underwear assembly 200 may not comprise the inner restraint mechanisms and the outer restraint mechanisms.

In the present aspect, the outer restraint mechanisms can be outer magnets 216 oriented to attract to the adjacent inner magnet 116 of the inner waistband 114. The outer magnets 216 can be represented by a first outer magnet 216*a* and a second outer magnet 216*b* on a front side of the outer waistband 214. The outer waistband 214 can further comprise a third outer magnet (not shown) and a fourth outer magnet (not shown) which can be disposed on a back side (not shown) of the outer waistband 214, and the third and fourth outer magnets can respectively align with the third inner magnet 116*c* and the fourth inner magnet 116*d* of the inner waistband 114 as shown. The first outer magnet 216*a* and the second outer magnet 216*b* can be respectively aligned and attached to the first inner magnet 116*a* (shown in FIG. 1) and the second inner magnet 116*b* (shown in FIG. 1). The quantity and distribution of outer magnets 216 can be complimentary to the quantity and distribution of inner magnets 116 such that each outer magnet 216 aligns and forms an adjacent pair with a one of the inner magnets 116 when the underwear assembly 200 is worn by the user.

In the present aspect, the inner magnets 116 and the outer magnets 216 can each be permanent magnets which create a persistent magnetic field. In other aspects, a first group of the outer restraint mechanisms and inner restraint mechanisms can be permanent magnets, and a second group of the outer restraint mechanisms and inner restraint mechanisms can comprise a magnetically attracted material such as a ferromagnetic or ferrimagnetic material. The restraint mechanisms comprising the magnetically attracted material can be paired with the permanent magnets to form attracting pairs of inner restraint mechanism and outer restraint mechanisms.

In the present aspect, each outer magnet 216 can be sewn into a pocket defined between a first layer and a second layer of the outer waistband 214 in order to secure the outer magnets 216 in the outer waistband 214 without causing discomfort to the user. The pocket can be configured to maintain and secure an orientation of each outer magnet 216 such that the orientation cannot be accidentally reversed. Securing and maintaining the orientation of each inner magnet 116 (shown in FIG. 1) and each outer magnet 216 is important to ensure that the inner magnets 116 and outer magnets 216 attract one another. For example, if a one of the inner magnets 116 is oriented with a northern pole of the inner magnet 116 facing outwards, then the adjacent outer magnet 216 should be oriented with a southern pole of the outer magnet 216 facing inwards in order for the inner magnet 116 to attract the outer magnet 216. If either the inner magnet 116 or the outer magnet 216 flips within its respective pocket, the inner magnet 116 and the outer magnet 216 will repel one another. In other aspects, each outer magnet 216 can be attached to the outer waistband 214 through a process such as gluing or any other suitable attachment process.

In other aspects, either or both of the inner restraint mechanisms and outer restraint mechanisms can be removable from the pockets. Removal of the inner restraint mechanisms and outer restraint mechanisms can be desirable, such as for machine washing the underwear assembly 200. In aspects in which some of inner restraint mechanisms or outer restrain mechanisms are magnetically attracted materials rather than permanent magnets, the pockets may not be configured to maintain and secure the orientation of the inner restraint mechanisms and outer restraint mechanisms because the permanent magnet will attract the magnetically attracted material regardless of orientation.

The underwear assembly 200 can be configured to restrain the shirt tail of the tucked-in shirt. While wearing the underwear assembly 200, the user can pull down the outer waistband 214 of the outer layer 201 around his or her hips and thighs, to the extent permitted by the attachment height $H_2$. The user can then arrange the shirt tail over the inner waistband 114 of the inner layer 100 such that the shirt tail covers an entirety of the inner waistband 114 around the waist of the user. Once the shirt tail is positioned, the user can pull the outer waistband 214 up and over the shirt tail, thereby positioning the shirt tail between the inner layer 100 and the outer layer 201. Upon pulling up the outer waistband 214, each outer magnet 216 attracts to each corresponding inner magnet 116, thereby pinching the shirt tail between the adjacent pairs of outer magnets 216 and inner magnets 116. In this configuration, the shirt tail is securely restrained by both the elastic nature of the outer waistband 214 and the attraction and pinching force demonstrated between the adjacent pairs of inner magnets 116 and outer magnets 216. The user can then put on pants, shorts, or a skirt over the underwear assembly 200, and the underwear assembly 200 can prevent pulling out and untucking of the shirt tail as well as blousing of the shirt around the waist of the user.

In the present aspect, the underwear assembly 200 can be used with an unmodified shirt. In some other aspects of the underwear assembly 200, the tucked-in shirt can be modified to work with the underwear assembly 200. For example, in some aspects in which the inner restraint mechanism or the outer restraint mechanism is a button, the shirt tail of the tucked-in shirt can be modified to define button holes which can cooperate with the button to restrain the shirt tail. In some other aspects, the inner restraint mechanism can be a tacky material, such as a rubber, which faces outwards, and the outer restraint mechanism can be a tacky material, such as a rubber, which faces inwards, and the inner restraint mechanism and the outer restraint mechanism can cooperate to grip the shirt tail. In some aspects, the underwear assembly 200 may not comprise the inner restraint mechanism or the outer restraint mechanism. In aspects comprising the shared waistband 314, such as the aspect of the underwear assembly 200 of FIG. 3 discussed below, the inner restraint material can be a tacky material, such as a rubber, which faces inwards to trap the shirt tail between the shared waistband 314 and the skin of the user. In some aspects comprising the shared waistband 314, the underwear assembly 200 may not comprise the inner magnets 116 and outer magnets 216. In some aspects wherein the shared waistband 314 comprises the tacky material, the tacky material can face outwards, and the tacky material can be configured to trap the shirt tail between the shared waistband 314 and a waistband of a user's pants, shorts, trousers, or other lower-body outerwear garment. In some aspects, the shared waistband 314 can comprise the tacky material positioned to face both inwards towards the skin of the user and outwards towards the waistband of the user's pants, shorts, trousers, or other lower-body outerwear garment.

Additionally, the multi-layer underwear with the access hole 112 can provide the desirable snug fit of boxer briefs for users around their legs while simultaneously providing the loose fit of boxers in the user's crotch area. This can be beneficial for users in athletic activities, such as golf, where both comfort and snugness are desired.

FIG. 3 is a front view of another aspect of the underwear assembly 200 in accordance with another aspect of the present disclosure with the inner layer 100 turned inside-out from the outer layer 201 for exemplary purposes. In the present aspect, the inner layer 100 and the outer layer 201 can be attached together by the shared waistband 314. When configured for use, the inner legs 108*a,b* can be tucked back into outer legs 208*a,b*, respectively, and the access hole 112 can be positioned in alignment with the access flap 212.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. An underwear assembly comprising:

an outer layer defining an access flap, the access flap configured to be pulled aside to create an outer hole in the outer layer, the outer layer comprising a first outer leg and a second outer leg joined together by a crotch;

an inner layer comprising a first inner leg and a second inner leg, the inner layer disposed within the outer layer, the first inner leg extending into the first outer leg, the second inner leg extending into the second outer leg, the inner layer comprising a front panel and a rear panel, the front panel configured to at least partially cover a front of a user, the rear panel configured to at least partially cover a rear of the user, the inner layer defining an access hole configured to receive a penis, a scrotum, and testicles of the user, the inner layer comprising an elastic material extending around the access hole, the access hole configured to prevent withdrawal of the penis, the scrotum, and the testicles from between the inner layer and the outer layer to internal to the inner layer through the access hole, the access hole being open in a relaxed state, the access hole configured to stretch to an enlarged state to receive the penis, the scrotum, and the testicles, the elastic material biasing the access hole from the enlarged state to the relaxed state; and a shared waistband, the outer layer and the inner layer each attached to the shared waistband; and wherein:

the inner layer is sized to provide a snug fit on the user; and the outer layer is sized to provide a loose fit on the user.

2. The underwear assembly of claim 1, wherein the access hole defines a rectangular shape.

3. The underwear assembly of claim 1, wherein the first inner leg is attached to the first outer leg.

4. The underwear assembly of claim 1, wherein:

the elastic material is a strip of elastic material; and the strip of elastic material extends around the access hole.

5. The underwear assembly of claim 1, wherein the first inner leg defines a first inner leg hole, and wherein the first inner leg hole is configured to receive a leg of the user.

6. A method of using an underwear assembly, the method comprising:

inserting a first leg of a user through a first inner leg hole of a first inner leg of an inner layer of the underwear assembly and a first outer leg of an outer layer of the underwear assembly, the inner layer positioned within the outer layer, the first inner leg at least partially extending into the first outer leg;

inserting a second leg of the user through a second inner leg hole of a second inner leg of the inner layer;

pulling a penis, a scrotum, and testicles of the user through an access hole defined by the inner layer comprising:

stretching the access hole from a relaxed state to an enlarged state, the access hole being open in the relaxed state;

passing the penis, the scrotum, and the testicles of the user through the access hole in the enlarged state; and securing the penis, the scrotum, and the testicles between the inner layer and the outer layer by contracting the access hole around a base of the penis and the scrotum; and pulling a shared waistband of the underwear assembly up to a waist of the user, the inner layer and outer layer each attached to the shared waistband.

7. The method of claim 6, further comprising:

pulling the penis through an access flap defined by the outer layer, comprising pulling the access flap aside to create an outer hole in the outer layer, the access flap being aligned with the access hole.

8. The method of claim 6, wherein the access hole defines a rectangular shape.

9. The method of claim 8, wherein the access hole defines a square shape.

10. The method of claim 6, further comprising:

contacting a shirt tail with a waistband, the waistband comprising a tacky material, the waistband attached to the inner layer.

11. The method of claim 6, wherein the first inner leg is attached to the first outer leg.

12. The method of claim 6, wherein:

the inner layer is sized to provide a snug fit on the user; and the outer layer is sized to provide a loose fit on the user.

13. The method of claim 6, wherein:

the inner layer comprises a front panel and a rear panel;

the front panel is configured to at least partially cover a front of the user; and the rear panel is configured to at least partially cover a rear of the user.

14. The method of claim 6, wherein the inner layer comprises a strip of elastic material extending around the access hole.

15. The method of claim 14, wherein stretching the access hole from the relaxed state to the enlarged state comprises stretching the strip of elastic material.

16. The method of claim 15, wherein contracting the access hole around the base of the penis and the scrotum comprises contracting the access hole under bias from the strip of elastic material.

17. An underwear assembly comprising:

an inner layer comprising a first inner leg, the first inner leg defining a first inner leg hole configured to receive a leg of a user, the inner layer defining an access hole configured to receive a penis, a scrotum, and the testicles of the user;

an outer layer covering the inner layer, the outer layer comprising a first outer leg, the first inner leg extending at least partially into the first outer leg, the outer layer defining an access flap, the access flap configured to be pulled aside to create an outer hole in the outer layer;

a waistband attached to the inner layer and the outer layer;

the access hole is open in a relaxed state;

the inner layer comprises a strip of elastic material extending around the access hole;

the access hole is configured to stretch to an enlarged state to receive the penis, the scrotum, and the testicles of the user; and the strip of elastic material biases the access hole from the enlarged state to the relaxed state.

18. The underwear assembly of claim 17, wherein the outer layer is attached to the waistband.

19. The underwear assembly of claim 17, wherein the access hole defines a rectangular shape.

20. The underwear assembly of claim 17, wherein the waistband of the underwear assembly comprises a tacky material, the tacky material configured to trap a shirt tail between the waistband and a waist of the user.

21. The underwear assembly of claim 17, wherein the first inner leg is attached to the first outer leg.

22. The underwear assembly of claim 17, wherein:

the inner layer is sized to provide a snug fit on the user; and the outer layer is sized to provide a loose fit on the user.

23. The underwear assembly of claim 17, wherein:

the inner layer comprises a front panel and a rear panel;

the front panel is configured to at least partially cover a front of the user; and the rear panel is configured to at least partially cover a rear of the user.

* * * * *